United States Patent [19]

Smith

[11] Patent Number: 4,986,781

[45] Date of Patent: Jan. 22, 1991

[54] FLOATING LOUNGE

[76] Inventor: Frederick C. Smith, R.R. 2, Box. 296A, Perkasie, Pa. 18944

[21] Appl. No.: 217,216

[22] Filed: Jul. 11, 1988

[51] Int. Cl.[5] ..... E04H 3/18

[52] U.S. Cl. ..... 441/130; 4/542

[58] Field of Search ..... 4/492, 541, 542, 543; 441/129, 130, 133, 136, 35

[56] References Cited

U.S. PATENT DOCUMENTS

| | | | |
|---|---|---|---|
| 3,287,741 | 11/1966 | Nash | 4/542 |
| 4,126,905 | 11/1978 | Russell et al. | 4/492 |
| 4,149,281 | 4/1979 | Bob et al. | 4/542 |
| 4,197,838 | 4/1980 | Shill | 4/542 |
| 4,430,762 | 2/1984 | Marshall | 4/541 |
| 4,466,141 | 8/1984 | Starkey | 4/542 |
| 4,468,822 | 9/1984 | McKay | 4/492 |
| 4,754,502 | 7/1988 | Bowen | 4/542 |

*Primary Examiner*—Joseph F. Peters, Jr.
*Assistant Examiner*—Edwin L. Swinehart
*Attorney, Agent, or Firm*—Joseph W. Molasky & Assocs.

[57] ABSTRACT

A floating lounge for use in a swiming pool or the like is disclosed. The floating lounge has a lounge body that is adapted to support a person in a reclined position while floating in water. The lounge body has an enclosed fluid distribution chamber and orifices distributed throughout the top surface thereof for delivering small jets of fluid under pressure onto a person supported on the lounge body in a reclined position to provide a massage-like action.

5 Claims, 2 Drawing Sheets

FIG. 3

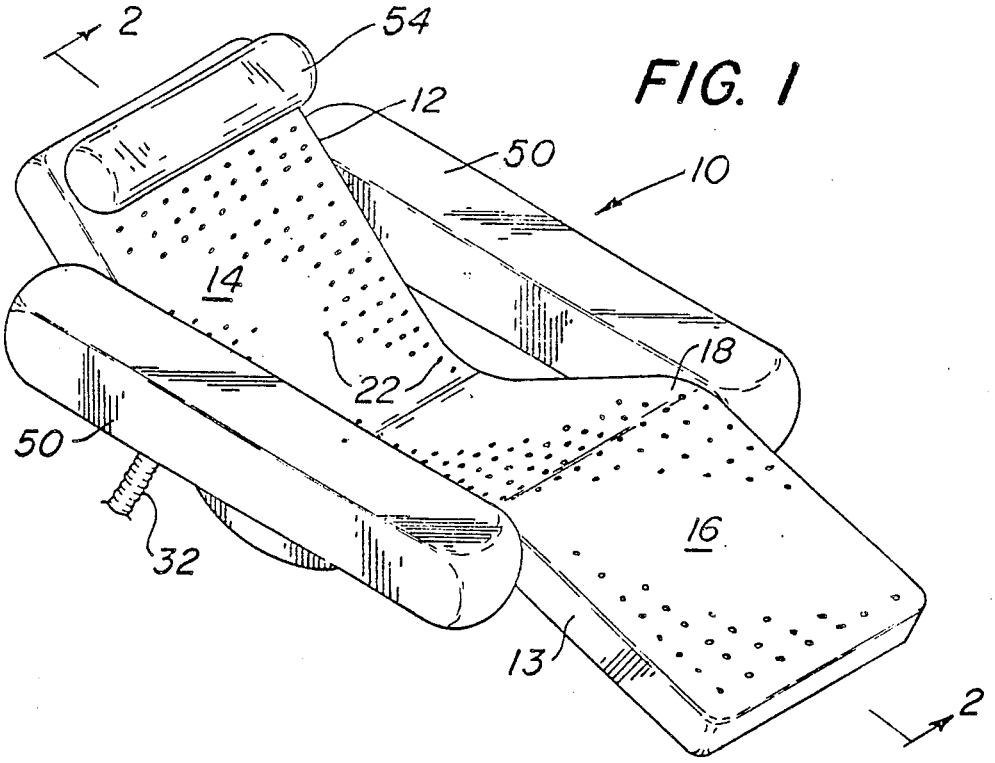
FIG. 1
FIG. 4
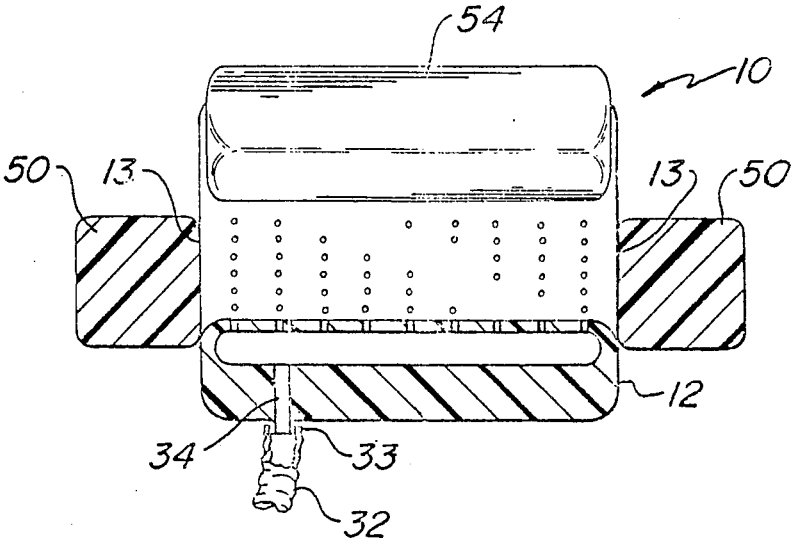

4
4
22
22
50
54
31
30
32
32
32
33
34
20
60
62

40
41
42
43
44
45
46
47
32

FLOATING LOUNGE

BACKGROUND OF THE INVENTION

1. Field of the Invention

This invention relates to lounges of the type adapted to float in the water of a swimming pool or the like with a person supported thereon in a reclined position.

2. Description of the Prior Art

Floating devices for supporting swimmers are well known in the art. U.S. Pat. No. 3,235,892 discloses an inflatable back rest or chaise for supporting a swimmer in the water in any of a vertical, a diagonal or a horizontal position. U.S. Pat. No. 4,564,240 discloses a reclining chair made from a floatable plastic body and constructed to be capable of floating in water with a swimmer thereon supported in a reclined position.

Spa devices for supplying jets of water to swimmers in a swimming pool are also known. Thus, U.S. Pat. No. 4,126,905 discloses a spa comprising an enclosure of about eight feet in diameter which is adapted to be floated in and connected to the existing facilities of a swimming pool and into which those desiring the treatment offered by a spa can enter and have heated water directed on them by way of jet devices. Also, U.S. Pat. No. 4,468,822 discloses a spa for use in a swimming pool and which includes a frame adapted to support a person in a reclined position in the pool. The frame is made of a plurality of frame members provided with apertures therein for directing liquid jets onto a person supported on the frame. There is also included aerating means for aerating liquid before it is expelled from the apertures. The device is constructed and arranged for a use such as the directing of spa water jets upon the spine of the person lying on the spa frame.

SUMMARY OF THE INVENTION

It is the general object of this invention to provide an improved floating lounge wherein a person supported on the lounge body in a reclined position has jets of fluid applied to his entire body by way of small orifices distributed throughout the surface of the lounge body.

Another object of the invention is to provide a floating lounge of the indicated type which has a simple construction whereby it can be made of a minimum of number of parts and at a minimum cost.

Briefly stated, the general objects of the invention are achieved by the provision of a floating lounge constructed of a lounge body adapted to support a swimmer in a reclined position while floating in water, the lounge body having an enclosed chamber providing a fluid distribution chamber and a plurality of orifices distributed throughout the surface thereof and extending between the flow distribution chamber and the top surface of the lounge body. Means are provided for supplying fluid under pressure to the flow distribution chamber whereby fluid is dispensed through the orifices onto a person supported on the lounge body to produce a massage-like action.

BRIEF DESCRIPTION OF THE DRAWINGS

FIG. 1 is a perspective view of a floating lounge in accordance with the present invention.

FIG. 4 is a sectional view taken generally on line 4—4 of FIG. 2.

DETAILED DESCRIPTION OF THE PREFERRED EMBODIMENT

Figures 2, 3:
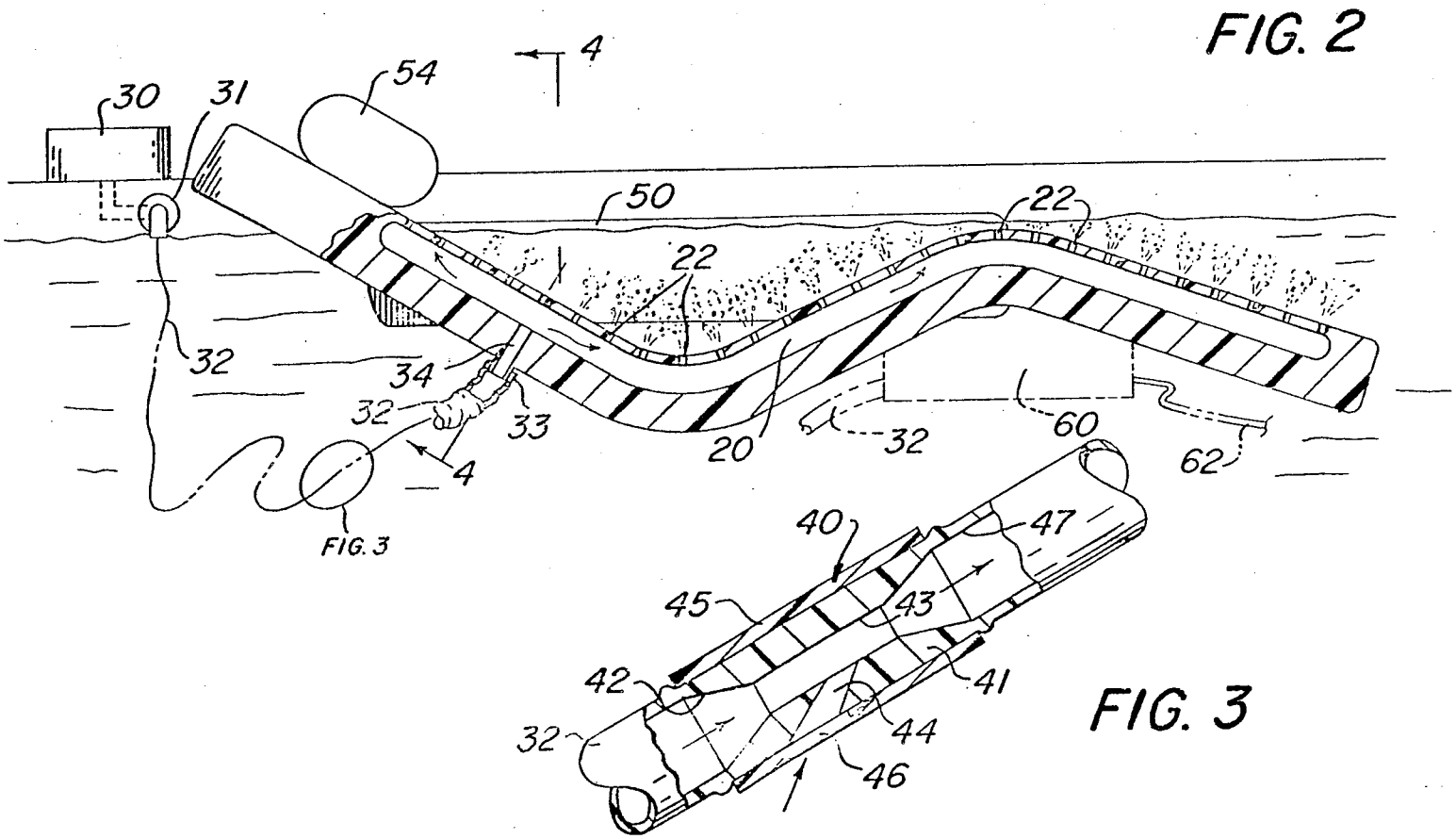
FIG. 2 is a sectional view taken generally on line 2—2 of FIG. 1.
FIG. 3 is an enlarged view of a detail, i.e., a injector device used to control the flow of fluid to the fluid distribution chamber in the lounge body.

Referring to the Drawings, there is shown a floating lounge, generally indicated at 10, adapted to support a person in a reclined position while floating in the water of a swimming pool, the floating position being best illustrated in FIG. 2. The lounge 10 comprises a lounge body 12 having a contoured configuration and preferably made of a molded plastic. The lounge body 12 may be made of various materials, such as, for example, acrylic, fiberglass, polyvinyl chloride or polyethylene. While the lounge body 12 is preferably made as a rigid construction, it may be made from a sufficiently strong semi-rigid foam if desired.

Lounge body 12 includes a back portion 14 of a size sufficient to support the back of a person supported thereon in a reclined position and an angular shaped seat portion 16 of a size to support the outstretched legs of a person supported thereon in a reclined position. The seat portion 16 has a bend 18 therein so as to support the legs of the person in a raised position with the legs bent at the knee. The configuration of the lounge body 12 is similar to the chaise lounges in use today.

Lounge body 12 is provided with an internal enclosed chamber 20 constructed and arranged to provide a fluid distribution chamber that extends throughout a substantial extent of the back portion 14 and the seat portion 16 of the lounge body 12 as is apparent from a consideration of FIGS. 2 and 4. Lounge body 12 has a plurality of orifices 22 distributed throughout substantially the entire top surface of the lounge body 12. Each of the plurality of orifices 22 provides flow communication from the flow distribution chamber 20 to the top surface of the lounge body 12 whereat the person is supported.

The orifices 22 are constructed and arranged to deliver small jets of fluid onto the person supported on the top surface of the lounge body 12 to provide a massage-like action. To this end, there are provided means for supplying fluid under pressure to the fluid distribution chamber. Such means comprises a small air pump or blower 30 which has its discharge fitting 31 connected to the upstream end of a flexible hose 32, which is connected at its downstream end to a fitting 33 formed on the underside of the lounge body 12. The fitting 33 is at one end of a passage 34 which communicates between the exterior of the lounge body 12 and the flow distribution chamber 20, as is best shown in FIG. 2.

An injector means 40 is located in hose 32 at a location indicated by the encircled region in FIG. 2, this region being designated "FIG. 3". The injector means 40 includes a venturi-shaped body 41 inserted in hose 32 and providing a convergent upstream wall 42 and a divergent downstream wall 47 adjacent a flow constricted passage 43. A passage 44 is arranged to provide flow communication between the exterior of body 41 and the constricted passage 43 for the entrainment of water into the air stream passing through venturi-shaped body 41. Valve means is provided for controlling the flow of water through passage 44, such valve means comprising a manually operable sleeve valve member 45 rotatably mounted on the exterior of body 41. Sleeve valve member 45 contains a flow control port 46 constructed and arranged to provide flow communication between the water in a swimming pool and the upstream end of passage 44 when valve member 45 is in its OPEN position as is shown in FIG. 3. Valve member 45 is manually rotatable between the OPEN position shown in FIG. 3 and a CLOSED position wherein the upstream end of passage 44 is closed by the valve member 45 to block flow of water through passage 44.

By this arrangement, a person supported on lounge body 12 can move the valve member 45 between its open and closed positions to control the nature of the jets of fluid to be discharged from ports 22. When valve member 45 is placed in the CLOSED position thereof, air under an elevated pressure is discharged by pump 32 to pass through hose 32 and venturi-shaped body 41 to be delivered to flow distribution chamber 20. This pressurized air then passes from chamber 20 through orifices 22 onto the person supported on lounge body 12. When valve member 45 is place in its OPEN position, the air flowing through the constricted passage 43 entrains water from the swimming pool through port 46 and passage 44 into the air stream flowing through hose 32 to the flow distribution chamber 20. Accordingly, a mixture of air and water is delivered to the flow distribution chamber 20 and is dispensed as small jets through orifices 22 onto a person supported on lounge body 12 to provide a massage-like action similar to that provided in spas.

There is also provided float means attached to lounge body 12 to provide sufficient buoyancy to lounge 10 so that the lounge body 12 will float in the water with a person supported thereon in a reclined position so that the head of the person is at all times above the water level. Such means comprises a pair of buoyant arm rests 50 attached to the sides of the lounge body 12 so as to extend longitudinally thereof and to provide a support for the arms of the person reclined on the lounge body 12. Arm rests 50 are preferably bonded to the side walls 13 of lounge body 12, although they may be attached in other ways.

There is also provided a semi-rigid foam cushion 44 which is bonded to the upper end of the back portion 14 of lounge body 12 to provide a head rest for a person supported on lounge body 12.

In FIG. 1 there is shown in dashed lines an alternate arrangement for the air supply. In this embodiment of the invention there is provided a portable air pump 60 which is mounted on board the lounge body 12 on the underside thereof as shown in FIG. 2. The air pump 60 delivers air to the hose line 32 which is connected thereto and is energized through a watertight power supply line 62 from a suitable power source. This alternate form of the invention operates in the same manner as the embodiment described above except that the source of pressurized air is on board the lounge body 12.

It will be apparent that various changes may be made in the construction and arrangement of parts without departing from the scope of the invention, which is defined by the following claims.

What is claimed is:

1. A floating lounge comprising a lounge body constructed to support a person in a reclined position on a top surface thereof including a back portion of a size and extending over an area to support the back of a person supported on the top surface over an area to support the outstretched legs of a person supported on the top surface of the lounge body, said lounge body defining an enclosed chamber therein providing a fluid distribution chamber, said chamber extending, in a wide two-dimensional configuration, across expansive regions of said back and seat portions underlying said areas of the top surface of the lounge body whereat the back and legs of a person are supported, said lounge body having a plurality of orifices providing flow communication from said flow distribution chamber to the top surface thereof on which the person is supported, said orifices being spread out over the length and breadth of said regions of said back and seat portions so as to deliver small jets of fluid from the flow distribution chamber onto expansive areas of the back and legs of a person supported on the lounge body to provide a massage-like action, means for supplying fluid under an elevated pressure to said flow distribution chamber to cause the fluid to be dispensed through said orifices onto a person supported on the top surface of the lounge body, and float means on said lounge body to provide sufficient buoyancy thereto so that the lounge body will float in water with a person supported thereon in a reclined position, said fluid supply means including a flexible hose, passage means for providing flow communication between the downstream end of said hose and the interior of said flow distribution chamber, said orifices being arranged in an array speed out in rows extending across the length and breadth of the top surface of the lounge body, air pumping means connected to the upstream end of said hose for delivering air under pressure thereto, said hose including an injector means for entraining water into the air flowing through said hose, and including valve means for controlling the flow of water to said injector means.

2. A floating lounge according to claim 1 wherein said valve means includes a sleeve valve member adapted to be manually operable between an open and closed position by the person supported on said lounge body.

3. A lounge body according to claim 1 wherein said air pump is supported on the underside of said lounge body for movement therewith.

4. A floating lounge comprising a lounge body constructed to support a person in a reclined position including a back portion of a size to support the back of a person supported on the lounge body and a seat portion of a size to support the outstretched legs of a person supported on the lounge body, said lounge body defining an enclosed chamber therein providing a fluid distribution chamber, said chamber extending throughout a substantial extent of said back portion and said seat portion of said lounge body, said lounge body having a plurality of orifices providing flow communication from said flow distribution chamber to the top surface thereof on which the person is supported, said orifices being distributed throughout the lounge body and being constructed and arranged to deliver small jets of fluid from the flow distribution chamber onto a person supported on the lounge body to provide a massage-like action, means for supplying fluid under an elevated pressure to said flow distribution chamber to cause the fluid to be dispensed through said orifices onto a person supported on the top surface of the lounge body, float means on said lounge body to provide sufficient buoyancy thereto so that the lounge body will float in water with a person supported thereon in a reclined position, said fluid supply means including a flexible hose and passage means for providing flow communication between the downstream end of said hose and the interior of said flow distribution chamber, an air pumping means connected to the upstream end of said hose for delivering air under pressure thereto, said hose including an injector means for entraining water into the air flowing through said hose, and valve means for controlling the flow of water to said injector means.

5. A floating lounge according to claim 4 wherein said valve means includes a sleeve valve member adapted to be manually operable between an open and closed position by the person supported on said lounge body.

* * * * *